US006451493B1

(12) United States Patent
Omokawa et al.

(10) Patent No.: US 6,451,493 B1
(45) Date of Patent: Sep. 17, 2002

(54) ELECTROPHOTOGRAPHIC PHOTOCONDUCTOR

(75) Inventors: Shinichi Omokawa; Masaru Takeuchi; Seizo Kitagawa, all of Matsumoto (JP)

(73) Assignee: Fuji Electric Imaging Device Co., Ltd., Nagano (JP)

( * ) Notice: Subject to any disclaimer, the term of this patent is extended or adjusted under 35 U.S.C. 154(b) by 0 days.

(21) Appl. No.: 09/714,822

(22) Filed: Nov. 17, 2000

(30) Foreign Application Priority Data

Nov. 17, 1999 (JP) ..... 11-326805

(51) Int. Cl.[7] ..... G03G 5/05
(52) U.S. Cl. ..... 430/56; 430/96
(58) Field of Search ..... 430/56, 96

(56) References Cited

U.S. PATENT DOCUMENTS 5,134,049 A * 7/1992 Kuroda et al. ..... 430/83
5,424,158 A * 6/1995 Murakami et al. ..... 430/83
5,629,117 A * 5/1997 Katsukawa et al. ..... 430/96

FOREIGN PATENT DOCUMENTS

| | | |
|---|---|---|
| EP | 0 506 387 A2 | 9/1992 |
| EP | 0 707 245 A2 | 4/1996 |
| EP | 0 896 975 A1 | 2/1999 |
| JP | 1-206349 | 8/1989 |
| JP | 1217351 | 8/1989 |
| JP | 3-290666 | 4/1990 |
| JP | 4-360148 | 12/1992 |
| JP | 5-092936 | 4/1993 |
| JP | 5150480 | 6/1993 |
| JP | 5-279582 | 10/1993 |
| JP | 7-179775 | 7/1995 |
| JP | 8-209023 | 8/1996 |
| JP | 9-151157 | 6/1997 |
| JP | 10-073937 | 3/1998 |

OTHER PUBLICATIONS

"Application of Unsymmetrical Diphenoquinone Derivatives to Xerography" Yamaguchi et al. Bulletin of the society of Electrophotography, vol. 30, No. 3 (1991), pp. 266–273.

(List continued on next page.)

*Primary Examiner*—Mark Chapman
(74) *Attorney, Agent, or Firm*—Venable; Robert J. Frank; Ashley J. Wells

(57) ABSTRACT

An electrophotographic photoconductor which is a positive charging, single layer type organic photoconductor including a conductive substrate; and a photosensitive layer which is provided on the conductive substrate, which is a positive charging, single layer type organic photoconductor, and which is composed of at least one charge generation substance that contains a phthalocyanine pigment; a positive hole transport substance; an electron transport substance; and a binder that contains a polycarbonate resin with a polydialkylsilozane constructed of a repeated unit represented by formula (1). Toner consumption during repeated electrophotographic use is reduced and print defects including dirty background suppressed.

(1)

7 Claims, 1 Drawing Sheet

OTHER PUBLICATIONS

"Application of Unsymmetrical Diphenoquinone Derivatives to Xerography (II)" Yamaguchi et al. Bulletin of the society of Electrophotography, vol. 30, No. 3 (1991), pp. 274–281.

"Development of Organic Electron Transport Materials" Kobayashi et al, Japan Hard Copy "92" Proceedings, Jul. 7–8, 1992, pp. 173–176.

"Synthesis and Xerographic Properties of Novel Naphthoquinone" Mizuta et al. Japan Hard Copy "97" Proceedings, Jul. 9–11, 1997, pp. 21–24.

"Synthesis and Properties of a Novel Electron Transporting Compound 3,3'–dialkyl–4,4'–bisnaphthylquinone (DBNQ)" Okada et al. "Pan–Pacific Imaging Conference/Japan Hard Copy 98" Preprints Jul. 15–17, 1998, pp. 207–210.

* cited by examiner

ELECTROPHOTOGRAPHIC PHOTOCONDUCTOR

This application is based on Japanese Patent Application Laying-open No. 11-326805 (1999) filed Nov. 17, 1999 in Japan, the content of which is incorporated here into by reference.

BACKGROUND OF THE INVENTION

1. Field of the Invention

The present invention relates to an electrophotographic photoconductor used for electrophotographic printers, copiers, and the like, more specifically to a single layer type positive charging organic photoconductor for electrophotography, which provides a good image quality even in repeated uses.

2. Description of the Related Art

Heretofore, as a photosensitive substance for electrophotographic photoconductor(hereinafter referred to as "photoconductor"), an inorganic photoconductor having a photosensitive layer comprising an inorganic photoconductive substance such as selenium, selenium alloy, zinc oxide, cadmium sulfide has been widely used as a main ingredient. However, recently, intensive research and development has been conducted for electrophotographic photoconductor using various organic photoconductive substances as materials for photosensitive layer which has been applied in practical applications in view of low production cost and prevention of industrial and environmental pollution.

Recently, in order to satisfy such performances as sensitivity and durability, as the photosensitive layer, a function separation lamination type photoconductor comprising a charge generation layer containing a charge generation substance and a charge transport layer containing a charge transport substance is in the mainstream. Above all, various kinds of lamination type organic photoconductors have been proposed. Each of them comprises a charge generation layer and a charge transport layer. The charge generation layer includes a charge generation substance made of resin with a deposited or dispersed organic pigment, and also the charge transport layer includes a charge transport substance made of a resin with a dispersed organic compound of low-molecular weight. In the organic photoconductors numerous substances having good positive hole transportabilities are known as charge transport substance. However, substances having a excellent abilities of transferring electrons(i.e., good electron transportabilities) are very few.

Therefore, the lamination type organic photoconductor described above is often prepared as a negatively charged one, in which an electron transport layer containing a positive hole transport substance is laminated on the charge generation layer. However, the negative charging lamination type organic photoconductor has disadvantages in that a specific system is required for uniform charging and a large amount of ozone is generated which deteriorates the environmental condition.

With the aim of improving the above problems, various positive charging organic photoconductors are proposed. However, as described above, in the case of the negative charging type, a substance having a good positive hole transportability can be used as the charge transport substance, whereas in the case of the positive charging type, substance having good electron transportability is very few. Further, even a substance with a relatively good electron transportability often has a toxicity or a carcinogenicity, therefore the use thereof has been difficult.

In addition, recently, several electron transport substances which introduced a solubilizing group into the electron acceptable structure are proposed. For example, those substances are described in Japanese Patent Application Laid-open Nos. 1-206349 (1989), 3-290666 (1991), 4-360148 (1992), 5-92936 (1993), 5-279582 (1993), 7-179775 (1995), 9-151157 (1997), and 10-73937 (1998). Furthermore, for example, those substance are described in Bulletin of the Society of Electrophotography vol. 30, No. 3, p266–273 and p274–281 (1991), "Japan Hard Copy '92"Proceedings, Jul. 6, 7, 8, 1992 JA Hall (Otemachi, Tokyo) p173–176, "Japan Hard Copy '97" Proceedings, July 9, 10, 11, JA Hall (Otemachi, Tokyo) p21–24, and "Pan-Pacific Imaging Conference/Japan Hard Copy '98" Preprints Jul. 15–17, 1998, JA HALL, Tokyo Japan p207–210. However, any of the compounds disclosed in the above documents is insufficient in its sensitivity and electrical characteristics when it is used in combination with the existing charge generation substance, thus there are problems in practical applications.

A lamination type organic photoconductor being positively charged has functionally separated layers (i.e., charge generation and charge transport layers). In this case, the charge transport layer is provided on a conductive substrate and contains an electron transport substance and the charge transport layer is provided on the surface of the charge transport layer and contains a charge transport substance. Further, a surface protection layer is necessary for the protection of the charge generation layer provided as a thin film. However, such a surface protection layer has the problems of the difficulty in its design and the need for being formed as a multilayer coating, resulting in increased cost. For solving such problems, furthermore, the photocoductor may be configured in a single layer type in which both the charge generation and transport substances are dispersed in a single film or in another type where a charge transport layer is further provided as the underlayer of such a configuration.

However, such a positive charging organic photoconductor does not always satisfy requirements for a photoconductor. In particular, one characteristic required to be improved is the control of the amount of toner deposited on the surface of the photoconductor. When toner is deposited in excess on the surface of the photoconductor, frequent maintenance becomes necessary because the toner consumption amount is increased. Further, the toner deposited in excess on the surface of the photoconductor tends to be a cause of print defect such as dirty background (toner deposition on a part which must be white in printing).

To improve such a disadvantage, in general, charging characteristics of the photoconductor are often controlled, and a change in composition of the photoconductor is essential for controlling the electrostatic characteristics. However, compositional change of the photoconductor is highly possible to generate a malfunction in association with the compositional change, requiring further changes in various photosensitive processes, which has problems of decreasing he development efficiency.

SUMMARY OF THE INVENTION

In view of solving the above problems, an object of the present invention is to provide a superior positive charging organic photoconductor having no print defects such as dirty background by considering the binder structure so as to be capable of reducing toner deposition amount to the surface of a single layer type positive charging photoconductor and the composition for reducing the toner consumption.

The inventors have conducted intensive studies for solving the above problems, found that the above object can be attained by using a polycarbonate resin containing polydialkylsiloxane having a specific repeating unit as a binder of a single layer type positive charging photoconductor and by containing a specific type of charge generation substance, and thus accomplished the present invention.

Specifically, the photoconductor of the present invention is an electrophotographic photoconductor comprising at least a photosensitive layer on a conductive substrate, wherein the photosensitive layer is a single layer type photosensitive layer containing at least a charge generation substance, a positive hole transport substance, an electron transport substance and a binder, wherein the binder contains a polycarbonate resin containing polydialkylsiloxane having a repeating unit represented by following formula (1):

(1)

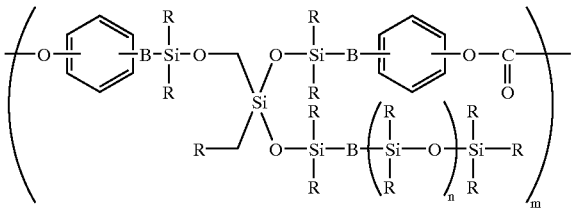

(wherein, R is alkyl group having 1 to 6 carbon atoms which may be the same as or different from each other, or a substituted or unsubstituted aromatic hydrocarbon group having 6 to 12 carbon atoms, B is $(CH_2)_x$, x is an integer from 2 to 6, n is an integer from 0 to 200, and m is an integer from 1 to 50), and the charge generation substance contains a phthalocyanine pigment. The electron transport substance is an acceptor compound.

In the present invention, the content of the polycarbonate resin is preferably 20 to 80 weight % of the total binder component, and the phthalocyanine pigment is preferably X-type nonmetallic phthalocyanine. Further, the positive hole transport substance preferably contains a compound represented by formula (2):

(2)

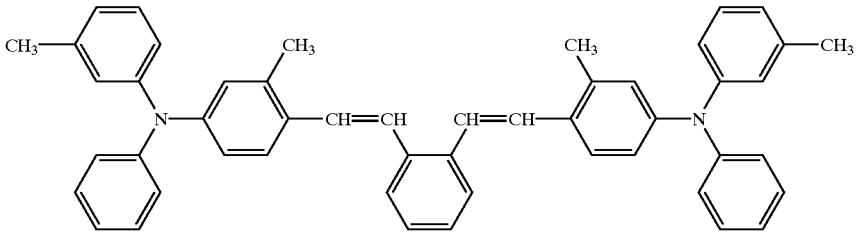

and the electron transport substance preferably contains a compound represented by formula (3):

(3)

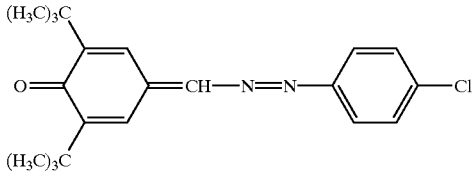

The above and other objects, effects, features and advantages of the present invention will become more apparent from the following description of the embodiments thereof taken in conjunction with the accompanying drawings.

DETAILED DESCRIPTION OF PREFERRED EMBODIMENTS

Figure 1:
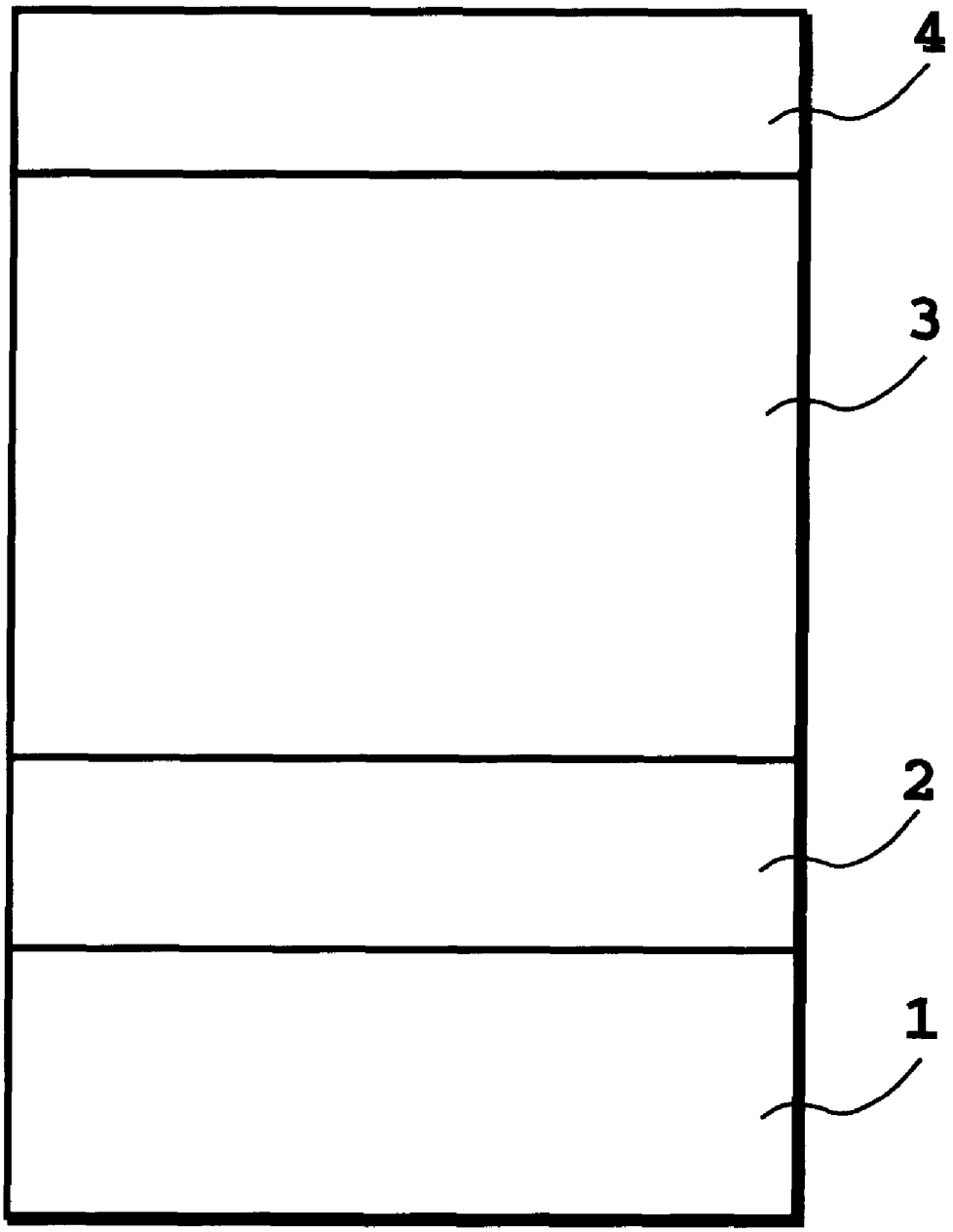
FIG. 1 is a schematic sectional diagram showing an embodiment of the electrophotographic photoconductor according to the present invention.

The electrophotographic photoconductor according to the present invention comprises at least a photosensitive layer formed on a conductive substrate. In the electrophotographic photoconductor of the present invention of such construction, an intermediate layer may be provided as necessary between the conductive substrate and the photosensitive layer in order for preventing injection of unnecessary charge from the conductive substrate, for covering defects on the substrate surface, and improving adhesion between the conductive substrate and the photosensitive layer. Further, to improve the printing resistance of the electrophotographic photoconductor, a protective layer may be provided as necessary on the photosensitive layer.

The above described photoconductor is shown in FIG. 1 as an embodiment of the electrophotographic photoconductor according to the present invention. As shown in FIG. 1, the electrophotographic photoconductor comprises a conductive substrate 1, and an intermediate layer 2, a photosensitive layer 3, and a protective layer 4, where respective layers are provided in order on the conductive substrate 1. In such an electrophotographic photoconductor, the photosensitive layer 3 is a single layer type photosensitive layer containing a charge generation substance, a positive hole transport substance, an electron transport substance and a binder, and having a functional charge generation function and charge transport function by a single layer.

In the following, each layer of the electrophotographic photoconductor according to the present invention will be described in detail with reference to FIG. 1.

The conductive substrate 1 has a role as electrode of the photoconductor and, at the same time, serves as substrates of other layers, which may be in the form of a cylinder, a plate, or a film. The material of the substrate may be a metal such as aluminum, stainless steel, or nickel, or glass or resin treated to provide an electrical conductivity.

The intermediate layer 2, provided as necessary, comprises a layer composed mainly of the binder or an oxide film such as alumite.

As the binder used in the intermediate layer 2, a copolymer of vinyl chloride and vinyl acetate and other resin components, or polycarbonate resin, polyester resin, polyvinyl acetal resin, polyvinyl butyral resin, polyvinyl alcohol resin, vinyl chloride resin, vinyl acetate resin, polyethylene, polypropylene, polystyrene, acrylic resin, polyurethane resin, epoxy resin, melamine, resin, silicon resin, silicone resin, polyamide resin, polystyrene resin, polyacetal resin, polyallylate resin, polysulfone resin, and a polymer of methacrylic ester and copolymers thereof can be used alone or in combination of two or more types.

Further, in the intermediate layer 2, it is possible to contain titanium oxide as fine particles of metal compound. In this case, however, the metal compound is not limited to titanium oxide but it is possible to use one of the other metal compounds that include silicon oxide(silica), zinc oxide, calcium oxide, aluminum oxide(alumina), and zirconium oxide. Alternatively, one or more metal sulfates such as barium sulfate and calcium sulfate or metal nitrides such as silicon nitride and aluminum nitride may be contained alone or in combination. Contents of these compounds can be flexibly set as far as a layer can be formed.

In the case of intermediate layer mainly comprising the binder, a positive hole transport substance can be contained for the purpose of providing positive hole transportability and reducing charge trap. Content of the positive hole transport substance is 0.1 to 60 weight %, preferably 5 to 40 weight % to the solid content of the intermediate layer.

Further, other additives which are well known can be contained as far as the electrophotographic characteristics are not substantially deteriorated.

Such an intermediate layer is used in a single layer, however, two or more layers of different types may be laminated.

Film thickness of the intermediate layer, although depending on composition of the intermediate layer, can be optionally set in a range as far as not generating an adverse effect such as an increase of residual potential when a photoconductor having such intermediate layer is used repeatedly and continuously.

The photosensitive layer 3 has a single layer structure mainly containing a charge generation substance, positive hole transport substance, electron transport substance (acceptor compound) and a binder.

In the present invention, as the charge generation substance, it is necessary to contain a phthalocyanine pigment, preferably X-type nonmetallic phthalocyanine, however, other charge generation substances can also be used alone or in combination of two or more types. As such other charge generation substances, in addition to phthalocyanine pigment, azo pigment, anthoanthrone pigment, perylene pigment, perynone pigment, polycyclic quinone pigment, squalirium pigment, thiapyrylium pigment, quinachrydone pigment and the like can be used, in particular, as the azo pigment, diazo pigment or trisazo pigment, as the perylene pigment, N,N'-bis(3,5-dimethylphenyl)-3,4,9,10-perylenebis(carboxyimide) and the like are advantageously used. Further, as the phthalocyanine pigment, nonmetallic phthalocyanine, copper phthalocyanine, titanyl phthalocyanine can be preferably used. More preferably, X-type nonmetallic phthalocyanine, $\tau$-type nonmetallic phthalocyanine, $\epsilon$-type copper phthalocyanine, E-type titanyl phthalocyanine, $\beta$-type titanyl phthalocyanine, Y-type titanyl phthalocyanine, amorphous titanyl phthalocyanine are used. When titanyl phthalocyanine described in Japanese Patent Application Laid-open No.8-209023 (1996): having a maximum peak of 9.6 degrees of Bragg angle $2\theta$ by CuK$\alpha$:X-ray diffraction is used, considerably improved effects are shown in terms of sensitivity, durability and image quality. Content of the charge generation substance is preferably 0.1 to 20 weight %, more preferably 0.5 to 10 weight % to solid content of the photosensitive layer.

As the positive hole transport substance, although not specifically limited, for example, hydrazine compound, pyrazoline compound, pyrazolone compound, oxadiazole compound, oxazole compound, arylamine compound, benzidine compound, stilbene compound, styryl compound, poly-N-vinylcarbazole, polysilane and the like can be used. These positive hole transport substances can be used alone or in combination of two or more types. Preferable positive hole transport substance used in the present invention is superior in positive hole transportability under irradiation with light, and suitable for combination with the charge generation. In particular, a compound represented by the following formula (2) is preferable:

(2)

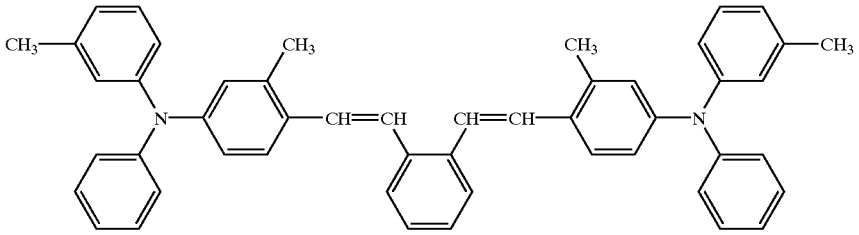

Content of the positive hole transport substance is preferably 5 to 80 weight %, more preferably 10 to 60 weight %, to solid content of the photosensitive layer.

As the electron transport substance, although not specifically limited, for example, electron transport substances (acceptor compounds) such as succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compound, quinone compound, benzoquinone compound, diphenoquinone compound, naphthoquinone compound, anthraquinone compound, stilbenequinone compound, and azoquinone compound can be used. These electron transport substances can be used alone or in combination of two or more types. A particularly preferable compound is one which is represented by following formula (3):

(3)

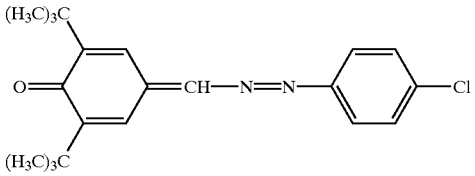

Content of the electron transport substance is preferably 1 to 50 weight %, more preferably 5 to 40%, to solid content of the photosensitive layer.

As the binder in the present invention, a polycarbonate resin containing polydialkylsiloxane having a repeating unit represented by following formula (1):

(1)

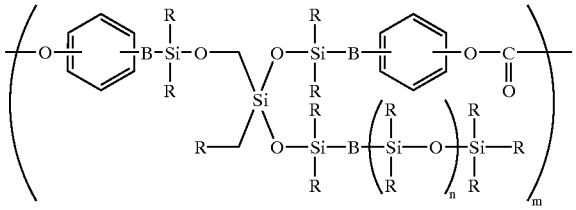

(wherein, R is alkyl group having 1 to 6 carbon atoms which may be the same as or different from each other, or a substituted or unsubstituted aromatic hydrocarbon group having 6 to 12 carbon atoms, B is $(CH_2)_x$ x is an integer from 2 to 6, n is an integer from 0 to 200, and m is an integer from 1 to 50), can be used alone, or in combination with polyester resin, polyvinyl acetal resin, polyvinyl butyral resin, polyvinyl alcohol resin, vinyl chloride resin, vinyl acetate resin, polyethylene, polypropylene, polystyrene, acrylic resin, polyurethane resin, epoxy resin, melamine resin, silicon resin, silicone resin, polyamide resin, polystyrene resin, polyacetal resin, polyallylate resin, polysulfone resin, and a polymer of methacrylic ester and copolymers thereof. Further, same type of resins with different molecular weights may be used by mixing.

A preferable example of polycarbonate resin containing polydialkylsiloxane having a repeating unit of formula (1) is TOUGHZET G-400 commercialized from Idemitsu Kosan Co. the compound being represented by the following formula:

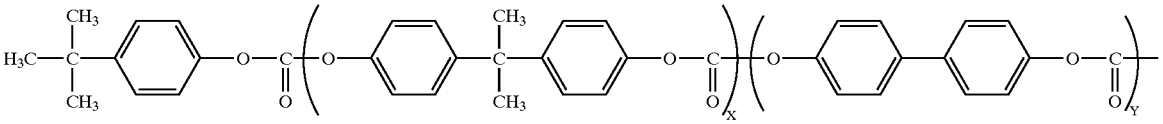

-continued

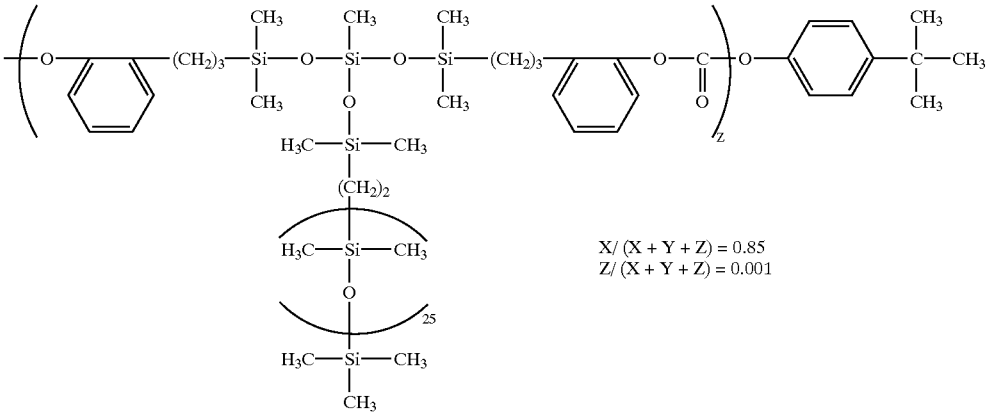

X/ (X + Y + Z) = 0.85
Z/ (X + Y + Z) = 0.001

Particularly preferable resins that can be used in combination with the polydialkylsiloxane-containing polycarbonate resin are as follows.

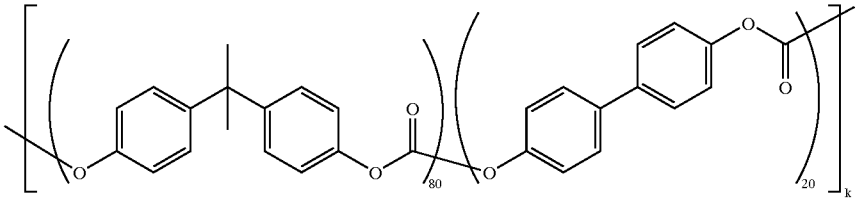

BPPC-3,5 (TOUGHZET B-200, TOUGHZET B-500 available from Idemitsu Kosan Co., TOUGHZET B-200 and B-500 are different each other in molecular weight. That is they have different number of "k".)

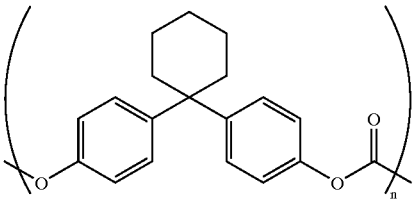

PCZ, bisZ-PC (PANLIGHT TS2050, PANLIGHT TS2020 available from Teijin kasei Co., PANLIGHT TS2050 and TS2020 are different each other in molecular weight. That is they have different number of "n".)

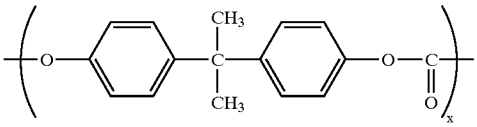

PCA (PANLIGHT K-1300 available from Teijin kasei Co.)

Content of the binder is preferably 10 to 90 weight %, more preferably 20 to 80 weight %, to solid content of the photosensitive layer, and the ratio of polydialkylsiloxane-containing polycarbonate resin having a repeating unit represented by formula (1) in the binder is preferably in the range of 1 to 100 weight %, more preferably 20 to 80 weight %.

Film thickness of the photosensitive layer 3 is preferably in the range of 3 to 100 μm, more preferably 10 to 50 μm, to maintain a practically effective surface potential.

In the photosensitive layer 3, for the purpose of improving the environment resistance and stability to harmful light, an age resistor such as an antioxidant or a photostabilizer can be contained. Compounds used for this purpose include chromanol derivatives such as tocopherol and esterified compounds, polyallylalkane compounds, hydroquinone derivatives, ether compounds, diether compounds, benzophenone derivatives, benzotriazol derivatives, thioether compounds, phenylenediamine derivatives, phosphonic esters, phosphorous esters, phenol compounds, hindered phenol compounds, straight-chain amine compounds, cyclic amine compounds, hindered amine compounds.

Further, in the photosensitive layer 3, for the purpose of improving leveling property of formed film and providing lubricating property, leveling agents such as silicone oil or fluorinated oil can be contained.

Still further, for the purpose of reducing frictional coefficient, providing lubricating property and the like, fine particles of metal compounds including metal oxides such as silicon oxide(silica), titanium oxide, zinc oxide, calcium oxide, aluminum oxide (alumina), zirconium oxide, metal sulfates such as barium sulfate, calcium sulfate, and metal nitrides such as silicon nitride, and aluminum nitride, or fluororesin particles such as tetrafluoroethylene resin or fluorinated comb type graft polymerization resin may be contained.

Yet further, as necessary, other additives which are well known can be contained as far as the electrophotographic characteristics are not substantially deteriorated.

The protective layer 4 which is provided as necessary comprises a layer composed mainly of the binder and an inorganic thin film such as amorphous carbon. In the binder, for the purpose of improving the conductivity, reducing the frictional coefficient, providing lubricating property and the like, fine particles of metal compound including metal oxides such as silicon oxide(silica), titanium oxide, zinc oxide, calcium oxide, aluminum oxide(alumina), zirconium oxide, metal sulfates such as barium sulfate, calcium sulfate, and metal nitrides such as silicon nitride, aluminum nitride, or fluororesin particles such as tetrafluoroethylene resin or fluorinated comb type graft polymerization resin may be contained.

Yet further, for the purpose of providing a charge transportability, the positive hole transport substance and the electron transport substance used in the above photosensitive layer 3 can be contained, and for the purpose of improving leveling property of formed film and providing lubricating property, leveling agents such as silicone oil or fluorinated oil can be contained.

Yet further, as necessary, other additives which are well known can be contained as far as the electrophotographic characteristics are not substantially deteriorated.

In the photoconductor according to the present invention, respective layers provided on the conductive substrate can be formed according to various methods known to those of ordinary skill in the art. For example, when the respective layers of the photoconductor are formed by coating, component materials of the respective layers may be dissolved or dispersed with an appropriate solvent by a conventional method such as paint shaker, ball mill, ultrasonic dispersion or the like to prepare a coating liquid, film formed by a conventional method such as dip coating, spray coating, blade coating, roll coating, spiral coating, slide hopper coating, and then dried.

As the solvent for preparing the coating liquid, various types of organic solvents can be used. As organic solvents used in the intermediate layer coating liquid, although not specifically limited, in general ether type solvents such as dimethyl ether, diethyl ether, 1,4-dioxane, tetrahydrofuran, tetrahydropyran, ethyleneglycol dimethyl ether, diethyleneglycol dimethyl ether and the like, and ketone type solvents such as acetone, methylethyl ketone, cyclohexanone, methyl isobutyl ketone, methyl isopropyl ketone are effectively used alone or as mixtures of two or more types, and, it is further possible to mix other organic solvents.

As the organic solvent used in the photosensitive layer coating liquid is preferably one which is low in solubility to the intermediate layer and can dissolve the material used in the photosensitive layer. In particular, it is effective to use halogenated hydrocarbons such as dichloromethane, dichloroethane, trichloroethane, chloroform, chlorobenzene, alone or in appropriate combination, and it is further possible to mix other organic solvents.

As the organic solvent used in the protective layer coating liquid, although not specifically limited, any type may be used which does not dissolve the photosensitive layer and does dissolve the material used in the protective layer.

EXAMPLES

In the following, the present invention will be described in detail with reference to the examples, however, application of the present invention is not limited to these examples. Unless otherwise noted, the word "part" in the description means "part by weight" and "%" means "weight %".

<Preparation of Electrophotographic Photoconductor>

Example 1

An electrophotographic photoconductor was formed on an aluminum-made cylindrical conductive substrate by successively coating an intermediate layer and a photosensitive layer of the following compositions using a dip coater.

Intermediate Layer

A film was formed using a coating liquid prepared by thoroughly dissolving the shown materials under agitation, and dried at 100° C. for 30 minutes to form an intermediate layer with a film thickness of 0.2 $\mu$m.

| | |
|---|---|
| Vinyl chloride-vinyl acetate-vinyl alcohol copolymer (SOLBIN A: Nisshin Kagaku Co.) (vinyl chloride 92%, vinyl acetate 3%, vinyl alcohol 5%) | 50 part |
| Methyl ethyl ketone | 950 part |

Photosensitive Layer

Of the following materials, those other than the binder are dispersed for 1 hour using a paint shaker, and then the binder is added, while thoroughly agitating, dispersed for further 1 hour to prepare a coating liquid. A film is formed using the coating liquid, and dried at 100° C for 60 minutes to form a single layer type photosensitive layer with a film thickness of 25 $\mu$m.

| | |
|---|---|
| Charge generation substance: X-type nonmetallic phthalocyanine | 2 part |
| Positive hole transport substance: positive hole transport substance of formula (2) | 65 part |
| Electron transport substance: electron transport substance of formula (3) | 28 part |
| Silicone oil: KF-54 (Shinetsu Kagaku Kogyo Co.) | 0.1 part |
| Binder: TOUGHZET G-400 (Idemitsu Kosan Co.) | 105 part |
| Methylene chloride | 1000 part. |

Example 2

A photoconductor was prepared using the same procedure as Example 1 except that the composition of photosensitive layer in Example 1 was changed to as what follows.

| | |
|---|---|
| Charge generation substance: X-type nonmetallic phthalocyanine | 2 part |
| Positive hole transport substance: positive hole transport substance of formula (2) | 65 part |
| Electron transport substance: electron transport substance of formula (3) | 28 part |
| Silicone oil: KF-54 (Shinetsu Kagaku Kogyo Co.) | 0.1 part |
| Binder: | |
| TOUGHZET G-400 (Idemitsu Kosan Co.) | 21 part |
| PANLIGHT TS2020 (Teijin Kasei Co.) (Bisphenol Z type polycarbonate resin) | 84 part |
| Methylene chloride | 1000 part. |

Example 3

A photoconductor was prepared using the same procedure as Example 1 except that the composition of photosensitive layer in Example 1 was changed to as what follows.

| | |
|---|---|
| Charge generation substance: X-type nonmetallic phthalocyanine | 2 part |
| Positive hole transport substance: positive hole transport substance of formula (2) | 65 part |
| Electron transport substance: electron transport substance of formula (3) | 28 part |
| Silicone oil: KF-54 (Shinetsu Kagaku Kogyo Co.) | 0.1 part |
| Binder: | |
| TOUGHZET G-400 (Idemitsu Kosan Co.) | 52.5 part |
| PANLIGHT TS2020 (Teijin Kasei Co.) (Bisphenol Z type polycarbonate resin) | 52.5 part |
| Methylene chloride | 1000 part. |

Example 4

A photoconductor was prepared using the same procedure as Example 1 except that the composition of photosensitive layer in Example 1 was changed to as what follows.

| | |
|---|---|
| Charge generation substance: X-type nonmetallic phthalocyanine | 2 part |
| Positive hole transport substance: positive hole transport substance of formula (2) | 65 part |
| Electron transport substance: electron transport substance of formula (3) | 28 part |
| Silicone oil: KF-54 (Shinetsu Kagaku Kogyo Co.) | 0.1 part |
| Binder: | |
| TOUGHZET G-400 (Idemitsu Kosan Co.) | 84 part |
| PANLIGHT TS2020 (Teijin Kasei Co.) (Binphenol Z type polycarbonate resin) | 21 part |
| Methylene chloride | 1000 part. |

Example 5

A photoconductor was prepared using the same procedure as Example 1 except that the composition of photosensitive layer in Example 1 was changed to as what follows.

| | |
|---|---|
| Charge generation substance: X-type nonmetallic phthalocyanine | 2 part |
| Positive hole transport substance: positive hole transport substance of formula (2) | 65 part |
| Electron transport substance: electron transport substance of formula (3) | 28 part |
| Silicone oil: KF-54 (Shinetsu Kagaku Kogyo Co.) | 0.1 part |
| Binder: | |
| TOUGHZET G-400 (Idemitsu Kosan Co.) | 94.5 part |
| PANLIGHT TS2020 (Teijin Kasei Co.) (Binphenol Z type polycarbonate resin) | 10.5 part |
| Methylene chloride | 1000 part. |

Example 6

A photoconductor was prepared using the same procedure as Example 1 except that the composition of photosensitive layer in Example 1 was changed to as what follows.

| | |
|---|---|
| Charge generation substance: X-type nonmetallic phthalocyanine | 2 part |
| Positive hole transport substance: positive hole transport substance of formula (2) | 65 part |
| Electron transport substance: electron transport substance of formula (3) | 28 part |
| Silicone oil: KF-54 (Shinetsu Kagaku Kogyo Co.) | 0.1 part |
| Binder: | |
| TOUGHZET G-400 (Idemitsu Kosan Co.) | 52.5 part |
| PANLIGHT TS2050 (Teijin Kasei Co.) (Binphenol Z type polycarbonate resin) | 52.5 part |
| Methylene chloride | 1000 part. |

Comparative Example 1

A photoconductor was prepared using the same procedure as Example 1 except that the composition of photosensitive layer in Example 1 was changed to as what follows.

| | |
|---|---|
| Charge generation substance: X-type nonmetallic phthalocyanine | 2 part |
| Positive hole transport substance: positive hole transport substance of formula (2) | 65 part |
| Electron transport substance: electron transport substance of formula (3) | 28 part |
| Silicone oil: KF-54 (Shinetsu Kagaku Kogyo Co.) | 0.1 part |
| Binder: PANLIGHT TS2050 (Teijin Kasei Co.) (Binphenol Z type polycarbonate resin) | 105 part |
| Methylene chloride | 1000 part. |

Comparative Example 2

A photoconductor was prepared using the same procedure as Example 1 except that the composition of photosensitive layer in Example 1 was changed to as what follows.

| | |
|---|---|
| Charge generation substance: X-type nonmetallic phthalocyanine | 2 part |
| Positive hole transport substance: positive hole transport substance of formula (2) | 65 part |
| Electron transport substance: electron transport substance of formula (3) | 28 part |
| Silicone oil: KF-54 (Shinetsu Kagaku Kogyo Co.) | 0.1 part |
| Binder: PANLIGHT TS2020 (Teijin Kasei Co.) (Binphenol Z type polycarbonate resin) | 105 part |
| Methylene chloride | 1000 part. |

Comparative Example 3

A photoconductor was prepared using the same procedure as Example 1 except that the composition of photosensitive layer in Example 1 was changed to as what follows.

| | |
|---|---|
| Charge generation substance: X-type nonmetallic phthalocyanine | 2 part |
| Positive hole transport substance: positive hole transport substance of formula (2) | 65 part |
| Electron transport substance; electron transport substance of formula (3) | 28 part |
| Silicone oil: KF-54 (Shinetsu Kagaku Kogyo Co.) | 0.1 part |

-continued

| | |
|---|---|
| Binder: TOUGHZET B-500 (Idemitsu Kosan Co.) | 105 part |
| Methylene chloride | 1000 part. |

Comparative Example 4

A photoconductor was prepared using the same procedure as Example 1 except that the composition of photosensitive layer in Example 1 was changed to as what follows.

| | |
|---|---|
| Charge generation substance: X-type nonmetallic phthalocyanine | 2 part |
| Positive hole transport substance: positive hole transport substance of formula (2) | 65 part |
| Electron transport substance: electron transport substance of formula (3) | 28 part |
| Silicone oil: KF-54 (Shinetsu Kagaku Kogyo Co.) | 0.1 part |
| Binder: TOUGHZET B-200 (Idemitsu Kosan Co.) | 105 part |
| Methylene chloride | 1000 part. |

<Evaluation of Electrophotographic Photoconductor>

The electrophotographic photoconductors obtained in above Examples 1 to 6 and Comparative Examples 1 to 4 were evaluated for the following 4 items.

1. Repetition Characteristic

After an image of print ratio of about 5% was continuously printed for 10,000 sheets using laser printer HL-1060 (Brother Kogyo Co.) under the environment of temperature at 22° C. and humidity of 48%, evaluation was made by measuring surface potential Vo (V) and exposed part potential VI (V). The evaluation results are shown in Table 1. As can be seen from Table 1, Examples 1 to 6 are small in reduction of Vo and increase of V1 after 10,000-sheet continuous printing as compared with Comparative Examples 1 to 4, showing that the repetition stability of charge potential is high.

2. Toner Consumption

Toner consumption amount was measured milligram of toner used until continuous printing of 10,000 sheets of an image of print ratio of about 5% using laser printer HL-1060 (Brother Kogyo Co.) under the environment of temperature at 22° C. and humidity of 48%, evaluation was made by calculating the toner consumption amount per 1 sheet printing. The evaluation results are shown in Table 1. As can be seen from Table 1, Examples are smaller as a whole in toner consumption amount than Comparative Examples, showing favorable results.

TABLE 1

Repetition characteristic and toner consumption

| | Initial | | After 10,000 prints | | Toner consumption |
|---|---|---|---|---|---|
| | Vo (V) | V1 (V) | Vo (V) | V1 (V) | mg/sheet |
| Example 1 | 1090 | 425 | 1050 | 470 | 23.0 |
| Example 2 | 1100 | 420 | 1070 | 465 | 27.2 |
| Example 3 | 1095 | 420 | 1080 | 465 | 25.3 |
| Example 4 | 1105 | 425 | 1075 | 475 | 24.1 |
| Example 5 | 1100 | 425 | 1055 | 475 | 23.8 |
| Example 6 | 1090 | 430 | 1070 | 475 | 26.5 |

TABLE 1-continued

Repetition characteristic and toner consumption

| | Initial | | After 10,000 prints | | Toner consumption |
|---|---|---|---|---|---|
| | Vo (V) | V1 (V) | Vo (V) | V1 (V) | mg/sheet |
| Comp. Ex. 1 | 1100 | 420 | 1000 | 510 | 32.2 |
| Comp. Ex. 2 | 1100 | 420 | 1020 | 505 | 31.6 |
| Comp. Ex. 3 | 1090 | 425 | 1005 | 520 | 30.9 |
| Comp. Ex. 4 | 1085 | 420 | 1000 | 505 | 32.0 |

3. Evaluation of Dirty Background

Dirty background was evaluated from color difference between white print which printed paper surface and unprinted paper. More specifically, using laser printer HL-1060 (Brother Kogyo Co.) under the environment of temperature at 22° C. and humidity of 48%, an image of print ratio of about 5% was continuously printed on 10,000 sheets, a white print was printed respectively on the first, 2,000th, 4,000th, 6,000th, 8,000th and 10,000th sheets, color difference from unprinted sheet was evaluated using reflective densitometer Model TC-6MC (Tokyo Denshoku Gijutsu Center Co.). Evaluation results are shown in Table 2. In Table 2, the greater absolute value means the greater degree of printing trouble.

TABLE 2

Evaluation of dirty background

| | Color difference (difference from unprinted paper) | | | | | |
|---|---|---|---|---|---|---|
| Print sheet | First sheet | After 2000 sheets | After 4000 sheets | After 6000 sheets | After 8000 sheets | After 10000 sheets |
| Example 1 | 0.71 | 1.31 | 1.18 | 1.39 | 1.36 | 1.42 |
| Example 2 | 1.54 | 1.76 | 1.49 | 1.70 | 1.91 | 1.88 |
| Example 3 | 1.20 | 1.18 | 0.99 | 1.18 | 1.46 | 1.39 |
| Example 4 | 0.98 | 0.89 | 1.42 | 1.27 | 1.50 | 1.31 |
| Example 5 | 0.95 | 1.02 | 1.21 | 1.38 | 1.35 | 1.46 |
| Example 6 | 1.34 | 1.82 | 1.90 | 1.69 | 2.18 | 2.10 |
| Comp. Ex. 1 | 3.50 | 3.55 | 3.45 | 3.83 | 4.26 | 4.66 |
| Comp. Ex. 2 | 3.18 | 2.90 | 3.31 | 3.58 | 3.20 | 3.42 |
| Comp. Ex. 3 | 2.93 | 3.34 | 3.28 | 3.51 | 6.73 | 6.60 |
| Comp. Ex. 4 | 3.61 | 3.52 | 3.85 | 4.22 | 5.92 | 5.57 |

4. Toner Deposition Evaluation of Photoconductor Surface

Using laser printer HL-1060 (Brother Kogyo Co.) under the environment of temperature at 22° C. and humidity of 48%, an image of print ratio of about 5% was continuously printed on 10,000 sheets, at the first sheet, 1,000th sheet, and 10,000th sheet, toner deposited on the photoconductor surface was peeled out with mending tape (Scotch Co.), toner amount deposited on the tape surface was evaluated using reflective densitometer Model TC-6MC (Tokyo Denshoku Gijutsu Center Co.). Evaluation results are shown in Table 3. In Table 3, the smaller value means the greater amount of toner deposition.

TABLE 3

Toner deposition evaluation of photoconductor surface

| Print sheet | Color difference | | |
|---|---|---|---|
| | First sheet | After 1000 sheets | After 10000 sheets |
| Example 1 | 76.21 | 76.02 | 75.53 |
| Example 2 | 75.25 | 75.17 | 74.67 |
| Example 3 | 75.56 | 75.22 | 75.01 |
| Example 4 | 75.88 | 75.90 | 75.51 |
| Example 5 | 76.20 | 75.94 | 75.46 |
| Example 6 | 76.08 | 75.94 | 75.66 |
| Comp. Ex. 1 | 73.11 | 73.00 | 72.53 |
| Comp. Ex. 2 | 74.01 | 73.55 | 73.17 |
| Comp. Ex. 3 | 72.86 | 72.70 | 71.56 |
| Comp. Ex. 4 | 72.99 | 72.38 | 71.11 |

As described above, with the present invention, a single layer type positive charging organic photoconductor having suppressed toner deposition to the surface of the photoconductor, improved print defects such as dirty background, and being superior in potential stability during repeated uses can be provided by using a polycarbonate resin containing polydialkylsiloxane having a specific repeating unit represented by formula (1) alone or by appropriately mixing other resin components, and containing a specific pigment as a charge generation substance. In particular, when the ratio of the polycarbonate resin having the structure of formula (1) in the total binder is 20 to 80 weight %, result in a good charge stability during repeated use results.

The electrophotographic photoconductor according to the present invention can be applied to exposure light sources such as a He-Ne laser, a semiconductor laser (780 nm, 680 nm, etc.), LED, halogen lamp, non-contact charging systems such as corotron, scorotron, contact charging systems such as roller, brush, and various copier printers and facsimiles provided with magnetic single component, non-magnetic single component, or two-component developing systems, obtaining advantageous effects.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An electrophotographic photoconductor which is a positive charging, single layer type organic photoconductor, comprising:

a conductive substrate; and a photosensitive layer which is provided on the conductive substrate, which is a positive charging, single layer type, and which is comprised of:

at least one charge generation substance that contains a phthalocyanine pigment;

a positive hole transport substance;

an electron transport substance; and a binder that contains a polycarbonate resin with a polydialkylsiloxane constructed of a repeated unit represented by formula (1) as follows:

(1)

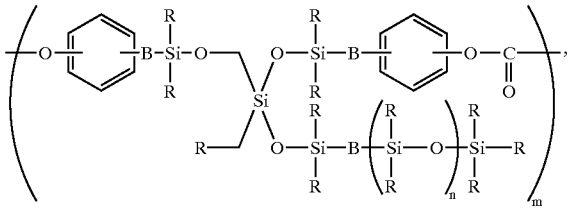

wherein

R is one of (a) an alkyl group having 1 to 6 carbon atoms which may be the same as or different from each other, or (b) an aromatic hydrocarbon group having 6 to 12 carbon atoms which is substituted or unsubstituted, B is $(CH_2)_x$ with x being an integer ranging from 1 to 6, n is an integer ranging from 0 to 200, and m is an integer ranging from 1 to 50.

2. The electrophotographic photoconductor as claimed in claim 1, wherein the binder contains from 20 to 80 weight % of the polycarbonate resin.

3. The electrophotographic photoconductor as claimed in claim 1, wherein the phthalocyanine pigment is an X-type, nonmetallic phthalocyanine.

4. The electrophotographic photoconductor as claimed in claim 1, wherein the positive hole transport substance contains a compound which is represented by formula (2) as follows:

(2)

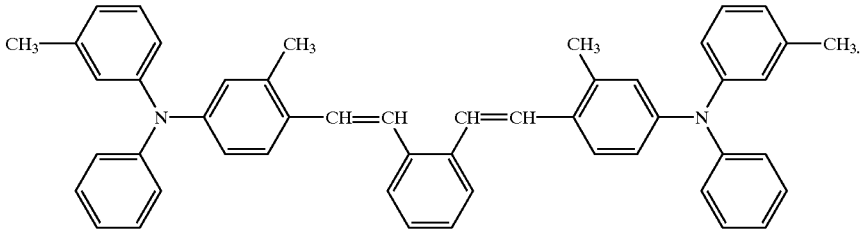

5. The electrophotographic photoconductor as claimed in claim 1, wherein the electron transport substance contains a compound which is represented by formula (3) as follows:

(3)

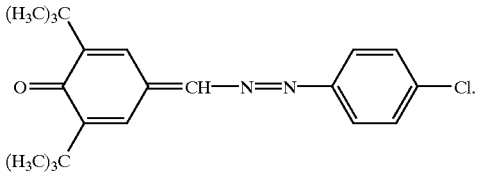

6. A method for reducing toner consumption during repeated electrophotographic use of a single layer, positive charging organic photoconductor, the method comprising the steps of:

providing an electrophotographic photoconductor according to claim 1; and repeatedly producing an electrophotographic image on the electrophotographic photoconductor employing positive charging, wherein the toner comsumption after producing 10,000 prints is reduced compared to single layer, positive charging organic photoconductor which do not comprise the photosensitive layer according to claim 1.

7. A method for suppressing print defects including dirty background during repeated electrophotographic use of a single layer, positive charging organic photoconductor, the method comprising the steps of:

providing an electrophotographic photoconductor according to claim 1; and repeatedly producing an electrophotographic image on the electrophotographic photoconductor employing positive charging, wherein the print defects including dirty background after producing 10,000 prints are reduced compared to single layer, positive charging organic photoconductor which do not comprise the photosensitive layer according to claim 1.

* * * * *